United States Patent [19]

Nuver

[11] 4,181,873

[45] Jan. 1, 1980

[54] HIGH FREQUENCY DIMMER CIRCUIT FOR HIGH INTENSITY, GASEOUS DISCHARGE LAMP

[75] Inventor: Eric L. H. Nuver, San Marcos, Tex.

[73] Assignee: Esquire, Inc., New York, N.Y.

[21] Appl. No.: 930,913

[22] Filed: Aug. 4, 1978

[51] Int. Cl.[2] ..... H05B 41/392

[52] U.S. Cl. ..... 315/291; 307/3; 315/199; 315/284; 315/311; 315/DIG. 4

[58] Field of Search ..... 315/194, 199, 208, 246, 315/284, 291, 307, 311, DIG. 4; 307/3, 73; 323/7

[56] References Cited

U.S. PATENT DOCUMENTS

| | | | |
|---|---|---|---|
| 3,816,794 | 6/1974 | Snyder | 315/194 |
| 3,894,265 | 7/1975 | Holmes et al. | 315/194 |
| 4,060,752 | 11/1977 | Walker | 315/307 X |

FOREIGN PATENT DOCUMENTS

| | | | |
|---|---|---|---|
| 2508923 | 9/1976 | Fed. Rep. of Germany | 315/DIG. 4 |

*Primary Examiner*—Eugene R. LaRoche
*Attorney, Agent, or Firm*—Frank S. Vaden, III

[57] ABSTRACT

A dimmer circuit for providing gate signal to a gated semiconductor connected for at least partial bypass operation of a ballast element of an HID lamp, the gate signal being derived from a high frequency voltage in a predetermined range. The high frequency voltage is separated from other frequencies and converted to a voltage proportional to the frequency. The voltage is then converted to a pulse within the timed operational limits of the line voltage for gating the semiconductor, and hence producing a brightness of the lamp between predetermined limits of full dim to full bright. Preferably, the high frequency voltage carrying the control information arrives superimposed on the line voltage to thereby avoid having to use a separate set of leads to the lamp to provide light level control signalling.

30 Claims, 7 Drawing Figures

HIGH FREQUENCY DIMMER CIRCUIT FOR HIGH INTENSITY, GASEOUS DISCHARGE LAMP

BACKGROUND OF THE INVENTION

1. Field of the Invention

This invention pertains to dimmer circuits for high intensity, gaseous discharge (HID) lamps and more particularly to such a dimmer that provides dimming circuit to the lamp through at least partial ballast reactive bypass as determined by the frequency of an applied high frequency signal within a predetermined range of high frequency.

2. Description of the Prior Art

U.S. Pat. No. 3,816,794, Snyder, describes a circuit employing a two-part reactive ballast connected in series with a high intensity, gaseous discharge lamp. One of the two elements of the ballast is connected across the main terminals of a triac operating as a gated bypass means. When the triac conducts, a current path is established through the triac, at least partially bypassing the reactive element. The duration of conduction determines the total amount of current through the ballast, and hence through the lamp, thereby providing a means for establishing the brightness of the lamp.

In the circuit described in U.S. Pat. No. 3,816,794, low gate source or drive voltage to the gate of the gates bypass triac is derived from a potentiometer, an isolating transformer circuit, a second triac and a Zener diode network, together with other components. The gated bypass triac is fired from a gate source voltage in phase with line voltage, the amplitude being controlled by a gate-signal control device including a Zener diode to properly time the turning on of the triac in relation to lamp current. The Zener diode also prevents the triac from being triggered past a time when there might be opposite polarity ballast-element voltage and lamp current, which would cause flicker of the lamp. Connection to multiple lamp circuits and to three-phase systems was cumbersome, and isolation of the triggering of the gated bypass triac and the power for the circuit was incomplete.

U.S. Pat. No. 3,894,265 discloses a circuit that provides a control network for the gated bypass network including the programmable unijunction transistor. Ready connection to single power and three-phase power systems is achieved, but the gating of the bypass triac is still not independent of the ac distribution voltage.

Although the gating of a gated semiconductor device for partial bypassing a ballast element is a very desirable means for providing dimming to an HID lamp, it is desirable to consider particular gating signal development for different circumstances. For example, when adding dimming to an existing lamp system, it is highly desirable to avoid additional leads to a gate control circuit. One technique that has proven useful is employing a superimposed high frequency voltage on the line voltage to provide the gate-controlling signal.

Therefore, it is a feature of the present invention to provide an improved dimmer circuit having a bypass triac or other gated means for at least partially bypassing a reactive ballast element connected to an HID lamp, the gate-controlling circuit including a network for taking the high frequency control voltage superimposed on the line voltage and converting it to a suitable gate voltage for timing the bypass operation and thereby providing a range of control from full dim to full bright operation of the HID lamp.

It is another feature of the present invention to provide an improved dimmer circuit having a bypass triac or other gated means for at least partially bypassing a reactive ballast element connected to an HID lamp, the gate-controlling circuit converting the frequency of a high frequency control voltage within an operating frequency range to a proportional voltage useful for gate trigger development.

It is still another feature of the present invention to provide an improved dimmer circuit having a bypass triac or other gated means for at least partially bypassing a reactive ballast element connected to an HID lamp, the gate-controlling circuit using a high frequency control signal to establish a proportional voltage which is subsequently translated into a pulsing signal for gating purposes.

SUMMARY OF THE INVENTION

The present invention employs a frequency-to-voltage converter in the heart of its network, the converter operated by a uniform amplitude square wave at the same frequency as the applied frequency of the control voltage. Preferably, this control voltage is superimposed on the line voltage and arrives on the same leads as applied to power the lamp which has the dimming circuit connected thereto. An initial stage of filtering separates the high frequency control signal from line and other lower frequency components received. A high gain amplifier and limiting network provide the square wave.

The proportional voltage to the control frequency in the preferred or illustrated embodiment is preferably developed in a voltage doubler network and is applied to a timer. The timer, also connected to the line voltage, creates pulses spaced from the zero-crossing points of the line voltage, a short time spacing being indicative of high control voltage and a longer time spacing being indicative of low control voltage. An RC network in front of the frequency-to-voltage converter assures that frequencies outside of the control range do not have an effect on the gating signal. Alternatively, other circuit connections could be made so that a short time spacing is indicative of low control voltage and a longer time spacing is indicative of high control voltage.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is noted, however, that the appended drawings illustrate only typical embodiments of the invention and are therefore not to be considered limiting of its scope, for the invention may admit to other equally effective embodiments.

In the Drawings.

DESCRIPTION OF PREFERRED EMBODIMENT

The invention described herein is an improvement of the dimming circuit described in U.S. Pat. No. 3,894,265, commonly assigned, and which is incorporated herein by reference for all purposes.

Figure 1:
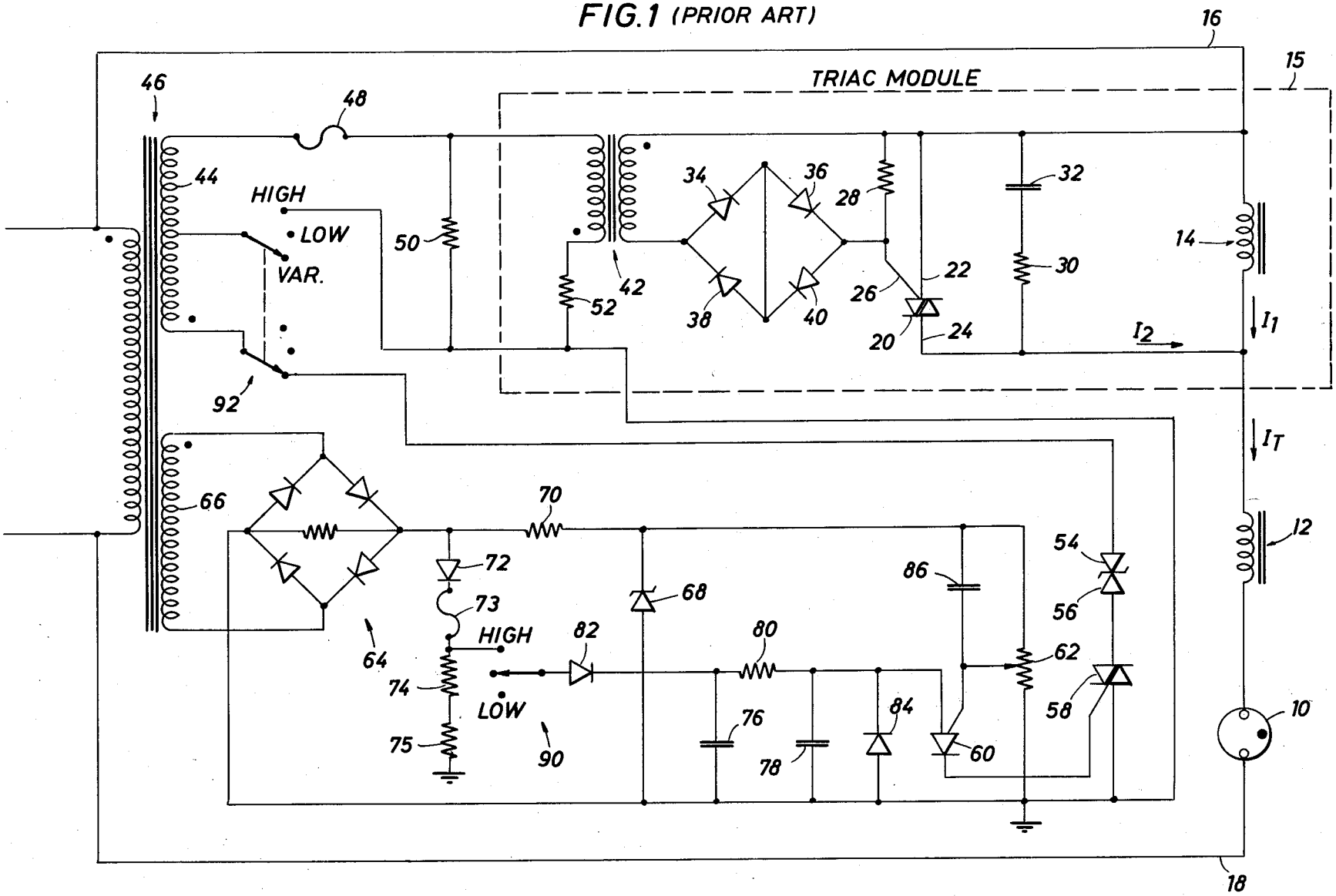
FIG. 1 (PRIOR ART)
FIG. 1 is a schematic diagram of a prior art dimming circuit employing a gated semiconductor for at least partially bypassing an inductive ballast element. The embodiment of the present invention achieves bypassing in a similar but different fashion.

Now referring to the drawings and first to FIG. 1, which is also FIG. 1 of U.S. Pat. No. 3,894,265, high intensity, discharge lamp 10 is connected in series with two inductive ballast elements 12 and 14, the entire combination being connected between lines 16 and 18. Gated bypass means in the form of triac 20 is connected across element 14, first main terminal 22 of the triac being connected to line 16 and second main terminal 24 being connected to a junction between the two elements. Of course, triac 20 can be a different type of gated semiconductor, if desired. Gate terminal 26 is connected to shunt resistor 28, which is also connected to line 16. Resistor 30 and capacitor 32, connected in series with each other and in parallel with element 14, are provided as a snubber device to provide triac 20 immunity from commutating dv/dt false turn on. Two pairs of diodes 34 and 36 and 38 and 40 connected to gate 26 provide the gate source voltage to triac 20 from transformer 42. These diodes are connected so that two diodes 34 and 36 face forward and two diodes 38 and 40 face backwards, with the junction point between each pair being connected together. Diodes 34, 36, 38 and 40 provide a slight forward voltage drop to block out the residual magnetizing force form transformer 42 and to thereby prevent false firing of triac 20. Everything between and including transformer 42 and its accompanying load resistor 52, and inductor 14 may be considered to be in "triac module" 15.

When triac 20 is conducting a form to complete bypass around element 14, a maximum amount of current flows through lamp 10. On the other hand, when triac 20 is not conducting then the minimum amount of current flows through lamp 10. By allowing triac 20 to conduct for part of the cycle, then the current through lamp 10, and hence the illumination therefrom, can be varied between the dim lamp current and full lamp current values. It is apparent, therefore, that merely controlling the period of conduction of triac 20 will achieve controllable illumination of lamp 10. A fuller explanation of the relationship of the phasing of the currents and voltages pertaining to the operation of the FIG. 1 circuit is given in U.S. Pat. No. 3,894,265.

Control of the conduction of triac 20 is accomplished by the controllable gate voltage means connected to transformer 42. To understand the operation of the control circuit, some additional phase relationships have to be appreciated. The voltage across element 14 (reactor voltage) is leading the lamp current by approximately 85° and also is leading the line voltage by approximately 30°.

In this prior art circuit, triac 20 should not be rendered conductive until current through and the voltage across element 14 are both of the same polarity, either both positive or both negative. If triac 20 was rendered conductive when the voltage across element 14 and the current therethrough were not of the same polarity, a phenomenon known as "half cycle conduction" would occur. The lamp would appear to flash from dim to full bright each half cycle and would produce an irritating strobing effect to the eye that would also be harmful to the lamp.

Power is applied to transformer 42 via the secondary 44 of power transformer 46 whose primary is connected across lines 16 and 18. One terminal of secondary 44 is connected to fuse or circuit breaker 48. Load resistors 50 and 52 connected to the two sides of the primary of transformer 42 are connected to ground. The power connection from the secondary 44 of transformer 46 to the primary of transformer 42 is through a bidirectional voltage regulating means in the form of cathode-to-cathode Zener diodes 54 and 56 and triac 58. It is well known that alternatively Zener diodes 54 and 56 may be connected anode-to-anode and operate in the same manner.

It is well known that the gate pulse to a triac controlling an inductive load is desirably a continuously applied gate voltage, having at least an appreciable duration, rather than an instantaneous pulse. Again referring to FIG. 1, it may be seen that cathode-to-cathode Zener diodes 54 and 56 are connected in series with the main terminals of triac 58, the entire combination being connected as previously mentioned in series with secondary 44 of transformer 46. It is readily apparent that the gate voltage has for its source from secondary 44 a voltage which is in phase with the voltage across lines 16 and 18, a voltage which may be referred to as the "gate source voltage". It is, of course, in phase with the line voltage across lines 16 and 18.

Connected to the gate terminal of triac 58 is the cathode of programmable unijunction transistor 60. The gate connection to PUT 60 is connected to a rectified dc voltage via variable resistor 62. The timing of the conduction of PUT 60 is determined by the voltage differential between the voltage applied via resistor 62 and the voltage applied to the anode of PUT 60. Both the voltage applied to the anode and to the gate of PUT 60 are important to its conduction. The anode voltage must be slightly larger than the gate voltage to cause conduction. That is, conduction is dependent on the arithmetic difference between the voltage applied to the anode and gate. Therefore, the setting of resistor 62 "programs" what anode voltage is required to produce conduction. The dc voltage applied to resistor 62 is developed by bridge rectifier 64 connected to secondary 66 of transformer 46. A Zener diode 68 and current limiting resistor 70 insures that the voltage applied to resistor 62 never exceeds a predetermined value.

The output from bridge rectifier 64 is also connected through diode 72, fuse 73 and variable resistor 74 to a time constant control network connected to the anode of PUT 60. This time constant network includes capacitors 76 and 78 and resistor 80. A diode 82 is included in series with the voltage from resistor 74.

A diode 84 in the anode circuit of PUT 60 and capacitor 86 in the gate circuit of PUT 60 insure positive reset of PUT 60 following conduction. It should be noted that the operating adjustment for PUT 60 is determined by variable resistor 62. The ultimate control for determining the amount of brightness of lamp 10 is determined by the setting of resistor 74. As PUT 60 ages, the setting of resistor 62 can be changed, as well as permitting an easy setting for initial conditions.

In operation, programmable unijunction PUT 60 is turned on by the voltage difference between the voltage on the anode of PUT 60 (voltage on capacitor 78) and the voltage on the movable contact of resistor 62. On each cycle of ac voltage applied to the bridge, there is a rise to a dc level at the output of this bridge for application to the gate of PUT 60 through resistor 62. In a more sluggish fashion, a voltage determined by the setting of resistor 74 is applied to the anode of PUT 60. When the differential in these two voltages is reduced at the gate and anode of PUT 60 to the point of causing conduction, a gate voltage is supplied to triac 58. Triac 58 conducts when the secondary voltage of 44 applied thereto exceeds the Zener diode voltage of diodes 54 and 56. When diodes 54 and 56 conduct, there is a complete circuit in secondary winding 44 of transformer 46. This permits voltage to be supplied to transformer 42.

Yet another method of achieving the desired timing of PUT 60 to achieve firing within the desired gate range, even without Zener diodes 54 and 56, can be accomplished by selecting the components of resistor 74, resistor 75, which is connected between resistor 74 and ground, resistor 80, capacitor 78, the voltage determined by Zener diode 68, and the setting of the voltage on the gate of PUT 60 by the setting of the voltage on the gate of PUT 60 by the setting of the movable arm on resistor 62. The setting is determined by placing variable resistance 74 at its lowest or dim setting.

The operation of the part of the FIG. 1 circuit not in triac module 15 may be better understood by reference to the description of the circuit which is more fully set out in U.S. Pat. No. 3,894,265.

Figure 2:
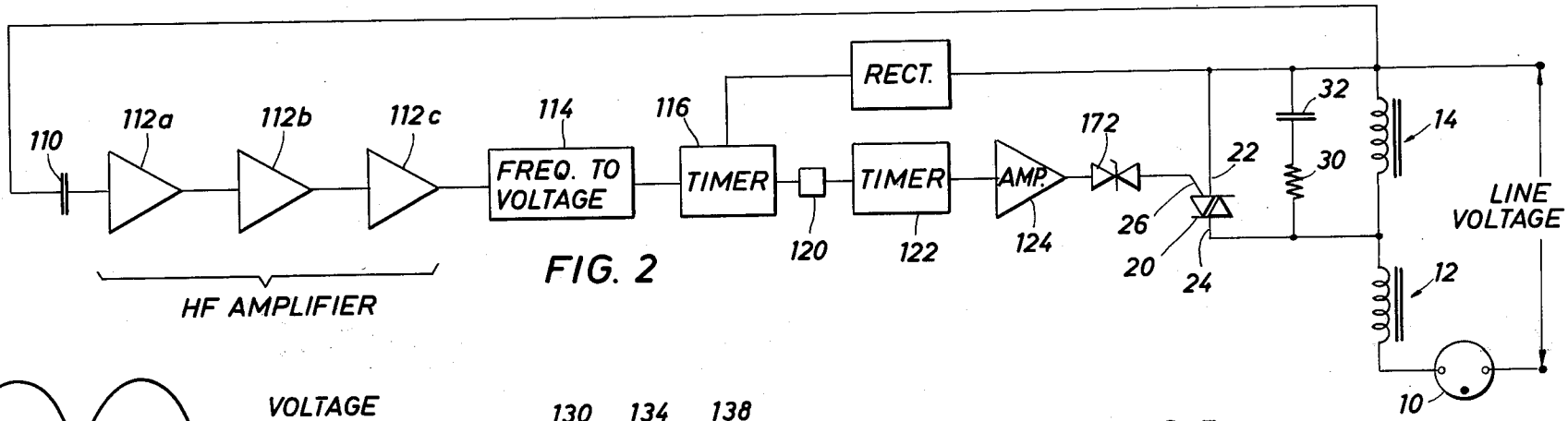
FIG. 2 is a functional block and simplified schematic diagram of a preferred embodiment of the present invention.

Now referring to FIG. 2, a block diagram of a high frequency gating circuit in accordance with the present invention is illustrated, the circuit being connected to gate 26 of triac 20 for operation in the manner discussed above with respect to the prior art circuit of FIG. 1. The timing of the gate pulse determines the conduction timing or conduction angle of triac 20 within the period of applied ac line or source voltage. Components essentially identical to components illustrated in FIG. 1 are illustrated with like numbers.

The line voltage applied to the lamp and ballast combination in a preferred embodiment of the present invention, has superimposed thereon a high frequency signal, the frequency thereof determining the gating to triac 20 and, hence, the dimming operation of lamp 10. Typically, the lowest high frequency is 20 KHz and the highest high frequency is 200 KHz. The line voltage is applied through capacitor 110, a component of an input network providing coupling and initial filtering. High gain amplifiers 112*a*, 112*b*, and 112*c* include CMOS networks to boost the incoming high frequency signal. Voltage limiting also occurs so that the output from the high frequency amplifiers is a constant amplitude square wave.

The square wave output from the amplifiers is applied to frequency-to-voltage converter 114. A relatively low frequency input produces a relatively low dc voltage output and a relatively high frequency input produces a relatively high dc voltage output.

Timer circuit 116 is typically a standard Model 555 timer produced by many manufacturers. An applied reference signal produces a first polarity output. An opposite polarity output is produced at a time thereafter determined by an applied dc level. So that there will be a signal produced from timer 116 each half cycle of line voltage, line voltage is applied to rectifier 118, which supplies a full-wave rectified input to timer 116 to produce the first polarity output. The second polarity output is produced shortly thereafter for a relatively high input voltage from frequency-to-voltage converter 114 and is produced at a later time thereafter for a relatively low input voltage from converter 114.

The square wave output from timer 116 is applied to differentiator 120. Hence, each time there is a polarity change in the output from timer 116, there is a spike output from the differentiator. A positive-going polarity change produces a positive spike and a negative-going polarity change produces a negative spike.

Figure 3:
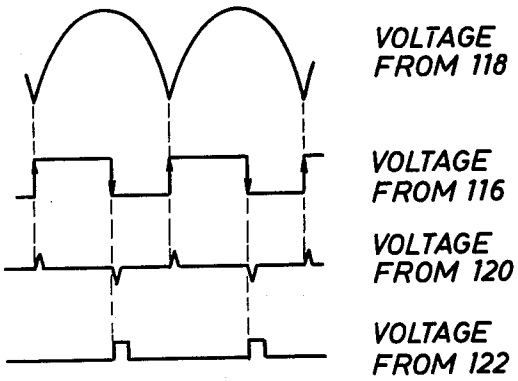
FIG. 3 is a waveform timing diagram of the operation of the circuit shown in FIG. 2.

A relatively constant level dc voltage is applied to timer 122 as one input thereto and the spike output from differentiator 120 is applied as the other input to timer 122, in this case the reference input. It should be noted that timer 122 is only sensitive to spikes in one polarity and, hence, it ignores the spikes occurring at the zero reference time of timer 116. Since a constant dc level is applied as the other input, the output is a series of square wave pulses of uniform width, starting at the time ultimately determined by the frequency of the dimming control signal. The timing of the signals just discussed is shown in FIG. 3. The output from timer 122 is amplified in amplifier 124 before being applied as a gate signal to triac 20.

It is very desirable to have the high frequency control signal operation be with respect to a high frequency band which is sharply determined. That is, the lowest high frequency signal should be set such that frequencies lower than that would have no effect on overall operation of the circuit. Likewise, the highest high frequency signal should be determined as the one producing the brightest lamp operation and frequencies above that high frequency would not effect overall circuit operation.

Figure 4:
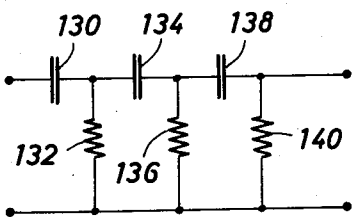
FIG. 4 is a simplified schematic diagram of the initial filter section of the circuit shown in FIG. 2.

A very satisfactory high pass filter for ensuring the filtering of 60 Hz, as well as some of the stronger commonly occurring harmonies thereof, superimposed motor noise and the like that may be present on the line, is illustrated in FIG. 4. Please also note that line voltage distortions would be reflected as a signal at various frequencies on the line, but filtering in the manner described herein even eliminates the effects of such distortion. Basically, the filter comprises three sections, namely capacitor 130 and resistor 132; capacitor 134 and resistor 136; and capacitor 138 and resistor 140. Each section accomplishes an attenuation of about −6 db per octave, hence, the combined filtering is −18 db per octave.

Although the rather straight forward filtering just described is adequate for operation, different filtering circuits or techniques may be employed instead of or in addition to the circuit shown in FIG. 4, if desired. High frequency filtering to cut off the frequencies above the highest operating frequencies is accomplished in a manner described below.

Operation of the circuit is best accomplished with the application of square waves, rather than sine waves.

Figure 5:
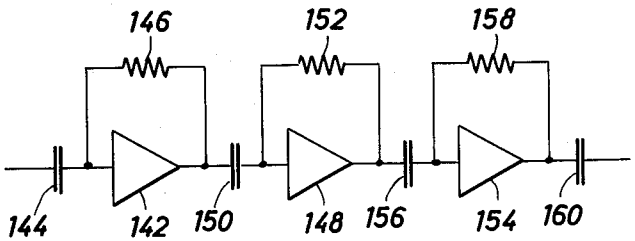
FIG. 5 is a simplified schematic of the input section of the circuit shown in FIG. 2, wherein a sine or other input waveform is converted to a square-wave shape.

Amplifier stages 112a, 112b and 112c accomplish this. An expanded functional diagram of circuit components for this purpose is illustrated in FIG. 5. The first stage comprises CMOS amplifier 142 connected to series capacitor 144 thereto and feedback resistor 146 therearound. Likewise, the second stage comprises CMOS amplifier 148 connected to series capacitor 150 and feedback resistor 152. The third stage, in similar fashion, comprises CMOS amplifier 154, series capacitor 156 and feedback resistor 158. An output capacitor 160 completes this high gain network.

The circuit basically provides a gain of between 5 and 10 for each stage and includes voltage limiting so that the result is a constant amplitude square wave at the high frequency applied at the input.

Although three CMOS amplifier stages are illustrated, it is understood that additional amplifier stages may be provided, if desired. Also, an effective and straight-forward method is illustrated for accomplishing square-wave production; however, alternate networks are available for such purpose.

Figure 6:
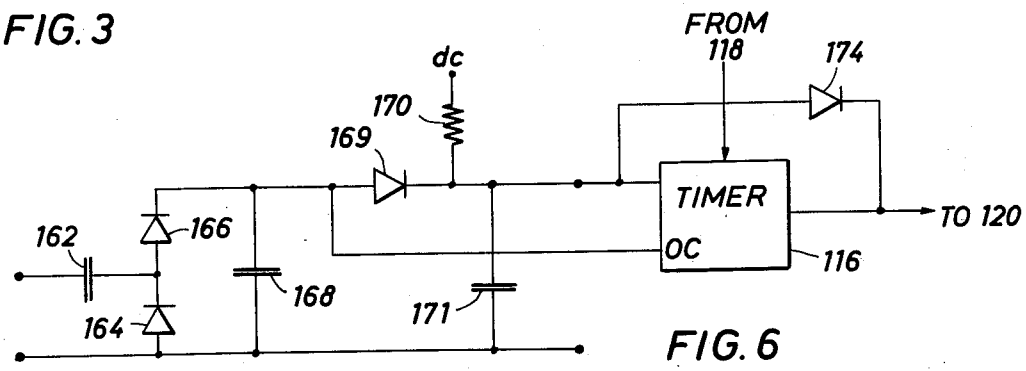
FIG. 6 is a simplified schematic of a voltage doubler network employed as a frequency-to-voltage converter, as illustrated in the circuit shown in FIG. 2.

Now referring to FIG. 6, a frequency-to-voltage converter is shown comprising input capacitor 162 connected to the cathode of diode 164, the common lead being connected to the anode of diode 164. The cathode of diode 164 is also connected to the anode of diode 166. The cathode output of diode 166 is connected to capacitor 168, thereby placing capacitor 168 across diodes 164 and 166. Capacitor 168 is connected to the anode of diode 169, whose cathode is connected to the junction between time constant determining resistor 170 and timing capacitor 171. Resistor 170 is connected to an applied dc level and capacitor 171 is connected to circuit common.

Capacitor 168 is connected to the open circuit connection of timer 116 and capacitor 171 is connected through a diode 174 to the output of timer 116.

In operation of the circuit shown in FIG. 6, which may be viewed as a voltage doubler, the input square wave amplitude is doubled at its output. The time constant determined by capacitors 168 and 171 and resistor 170, as more fully explained hereinafter, permits the input square wave to build up to a voltage level compatible with the frequency of the line voltage applied to lamp 10. That is, a frequency of the lowest high frequency having meaning to circuit operation (e.g., 20 KHz) results in a low-voltage amplitude for "dim" operation, as hereinafter further explained. A frequency of the highest high frequency having meaning to circuit operation (e.g., 200 KHz) results in a high-voltage amplitude for "full bright" operation.

Although the circuit shown in FIG. 6 is referred to above as a "voltage doubler" it should be recognized that the ratio of capacitor 168 to capacitor 162 determine the transfer characteristics for the circuit, and hence the output could be something other than double the input, either lesser or greater than that amount.

Figure 7:
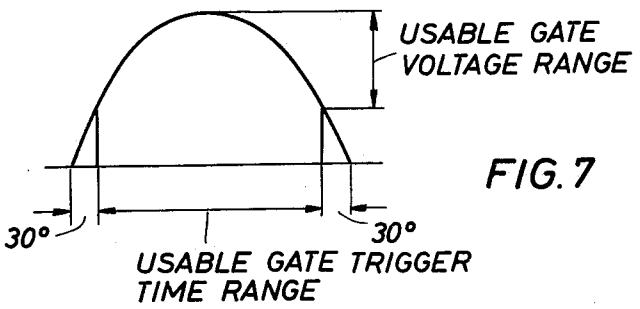
FIG. 7 is a diagram showing the timing range for application of a gate signal to the gated semiconductor in the circuit shown in FIG. 6 in accordance with the present invention.

When there is no high frequency applied to the FIG. 6 circuit, or when a low frequency signal is applied below the threshold frequency (e.g., below 20 KC), there is insufficient voltage build up on capacitor 168 during the one-half cycles of the rectified voltage from rectifier 118 to cause conduction of diode 169. Hence, under these conditions, only timing resistor 170 and capacitor 171 determine the voltage output setting from the timer 116. The RC time constant of these components alone cause operation to cause the negative-going slope to be at or near the end of the usable gate trigger time range as shown in FIG. 7. That is, the latest trigger operation is under the conditions when diode 169 is not rendered conductive, as described above.

When the output of timer 116 goes to zero, as shown in FIG. 3, the charge on capacitor 171 is discharged through diode 174. The capacitor remains discharged until the output again goes to its high value at the start of a new half cycle of the voltage from 118.

When the voltage on capacitor 168 does build up to cause diode 169 to conduct, then the voltage applied to timer 116 is determined by resistor 170 and capacitors 168 and 171. Capacitor 168 is connected for discharge purposes to the open circuit input of timer 116. When the threshold voltage causes timer 116 to operate, the internal semiconductor connected to the open circuit input conducts to discharge capacitor 168. Since this happens each half cycle, capacitor 168 is discharged each half cycle. No diode is required, such as diode 174 with respect to capacitor 171, since the internal semiconductor performs the necessary high impedance, open circuit function.

It can now be explained how the highest high frequency having meaning to circuit operation is determined. The limit of the square wave input is a frequency occurring so fast that effectively a constant level dc is applied to the FIG. 6 output. Since the output includes a resistor, build-up is determined by the time constant of this resistor and capacitor 168. Applying constant dc is going to result in the maximum level output from the frequency-to-voltage converter, this level being the same output level as for the highest applied high frequency having meaning. Hence, a higher frequency than such highest frequency would not have an effect on circuit operation.

Between the frequencies of the lowest and highest of these high frequencies, the output voltage is substantially linearly proportional to the frequency of the input. Hence, the circuit operates as a frequency discriminator. Also, it should be noted that the lowest voltage level is set by the dc bias voltage applied to resistor 170.

A Model 555 includes a timing network, a semiconductor switch, a voltage source and a voltage divider. The switch of timer 116 is turned on by a positive-going reference cycle from rectifer 118, which produces a dc voltage divided down from a dc bias level to be a desirable dc operating level. At the same time, a timing network begins, which switches such dc bias to zero in accordance with the applied input from converter 114. Such a timing network includes a ramp voltage generator starting from the applied input voltage level. A high input results in quick switching after the reference and a low input results in delayed switching. The resulting output appears as shown in FIG. 3, the distance of the negative-going edge from the positive-going edge being determined by the voltage level from converter 114. A voltage which is too low (representing no input bypassing signal) results in no bypassing operation occurring, and, hence, full dim operation.

The output from timer 116 is applied to differentiator 120, which may merely comprise a series capacitor and a resistor connection to the common lead. The spike-type output shown in FIG. 3 results.

Timer 122 is similar to timer 116. In this case, the reference is the negative-going spike shown in FIG. 3, and a constant level dc is the other input. The resultant output are the square-wave type signals shown in FIG. 3. Although the above description is with regard to a circuit operating with respect to the negative spikes and ignoring the positive spikes, opposite operation is possible through the use of a voltage inverter.

Referring again to FIG. 6 there is another characteristic involved in the operation of the circuit at the low end that provides a low-end frequency cut-off point. The slow voltage build-up of a voltage applied having a frequency below the operational lower limit results in an output that is operates timer 116 at the latest timing point, which means full dim operation.

FIG. 7 illustrates the timing range of the line voltage over which bypass operation occurs. The limits thereof at the 30° points are set in the fashion determined by either anode-to-anode Zener diodes or by cathode-to-cathode Zener diodes 172, as illustrated in FIG. 2 as being in the gate lead to triac 24. More complete description of the timing bypass operation is given in U.S. Pat. No. 3,894,265.

Amplifier 124 can be a dc amplifier, in which event there would be no Zener diode 172. In this event the only limitation of the occurrence of the voltage pulses from timer 122 is that they occur during the one-half cycles of line voltage, triac 20 turning off because of natural commutation each half cycle of phase reversal of the line voltage.

While a particular embodiment of the invention has been shown and described, it will be understood that the invention is not limited thereto, since many modifications may be made and will become apparent to those skilled in the art. For example, the applied control frequency can be applied independently of line voltage on separate leads. Also, there can be modification of frequency, if desired. That is, the frequency of the control voltage does not have to be preserved throughout, but may be modified to be in a different range, if desired.

Furthermore, it shall be noted that the embodiment shows a ballast connected to the lamp having two separate ballast elements. It is obvious that partial bypassing can be provided by a ballast having two elements loosely magnetically coupled, the lamp being connected to one such element or winding and the gated semiconductor being connected to the other of such elements.

What is claimed is:

1. In a gaseous discharge lamp dimming circuit including a ballast connected to the lamp having a gated semiconductor connected thereto for at least partially bypassing an element thereof, the improvement in a gate-controlling circuit connected to the gate of the semiconductor comprising receiving means connected to receive a high frequency voltage, said receiving means including means for producing a square wave from the applied high frequency voltage, frequency-to-voltage converter means connected to said receiving means for producing a voltage proportional to the frequency of the square wave applied thereto, timing means connected to the line voltage connected for powering the lamp and to said converter means for producing a gate signal to said gated semiconductor, a high frequency voltage to said receiving means at a predetermined lowest frequency producing a full dim brightness response, a high frequency voltage to said receiving means at a predetermined highest frequency producing a full bright brightness response, and a high frequency therebetween producing a brightness response therebetween.

2. A gate-controlling circuit in accordance with claim 1, wherein said receiving means is connected to the line voltage, the line voltage having superimposed thereon the high frequency voltage, said receiving means including filtering means for separating the high frequency voltage from the line voltage and lower frequency voltages at frequencies below the lowest high frequency voltage.

3. A gate-controlling circuit in accordance with claim 2, wherein said filtering means includes a plurality of high pass filters for greatly attenuating frequencies below 20 KHz.

4. A gate-controlling circuit in accordance with claim 1, wherein said receiving means includes high gain amplifier and limiting means for producing a predetermined constant-amplitude, square-wave voltage at the same frequency as that applied thereto.

5. A gate-controlling circuit in accordance with claim 4, wherein said high gain amplifier and limiting means include a plurality of CMOS amplifier stages.

6. A gate-controlling circuit in accordance with claim 1, wherein said frequency-to-voltage converter means includes a voltage doubler.

7. A gate-controlling circuit in accordance with claim 1, wherein said frequency-to-voltage converter means includes a frequency discriminator having a capacitor and a diode gate, a voltage at a frequency below said lowest frequency not establishing sufficient voltage on said capacitor to cause conduction of said diode gate for modifying the gate signal from said timing means to said gated semiconductor.

8. A gate-controlling circuit in accordance with claim 7, and including discharge means connected to said capacitor for discharging said capacitor prior to the period of each one-half cycle of line voltage.

9. A gate-controlling circuit in accordance with claim 1, wherein said frequency-to-voltage converter means includes an RC time constant network having a frequency discriminator for frequencies above said highest frequency, a frequency at said highest frequency effectively producing a square wave that builds to a predetermined voltage level during the period of one-half cycle of line voltage indicative of said full bright response.

10. A gate-controlling circuit in accordance with claim 9, and including discharge means connected to a capacitor portion of said RC time constant network for discharging said capacitor prior to the period of each one-half cycle of line voltage.

11. A gate-controlling circuit in accordance with claim 10, wherein said discharge means includes a diode connected to said capacitor and the output of said timing means.

12. A gate-controlling circuit in accordance with claim 1, wherein said timing means includes means for producing uniform square-wave pulses at a time within the half cycles of the line voltage determined by the frequency of the applied high frequency voltage, the predetermined highest frequency producing said pulses shortly following the beginning of the half cycles and the predetermined lowest frequency producing said pulses shortly before the ending of the half cycles.

13. A gate-controlling circuit in accordance with claim 12, wherein said timing means includes a first timer activated by the anticipated zero-crossing of the line voltage to produce a positive-going square-wave edge to a first voltage level, the voltage from said converter means producing a negative-going square-wave edge to a second voltage level, and a second timer connected to said first timer and to a constant level dc voltage for producing a uniform square-wave pulse starting at the occurrence of said negative-going square wave.

14. A gate-controlling circuit in accordance with claim 13, and including a differentiator connected to the output of said first timer and the input of said second timer for producing a spike pulse at the occurrence of said negative-going square-wave edge.

15. A gate-controlling circuit in accordance with claim 1, and including two series, oppositely connected Zener diodes for assuring that bypass gating of said semiconductor only occurs within a predetermined range of occurrence of line voltage.

16. For use in a gaseous lamp dimming circuit including a ballast connected to the lamp having a gated semiconductor connected thereto for at least partially bypassing an element thereof, the improvement in a gate-controlling circuit connected to the gate of the semiconductor comprising receiving means connected to receive a high frequency voltage, said receiving means including means for producing a square wave from the applied high frequency voltage, frequency-to-voltage converter means connected to said receiving means for producing a voltage proportional to the frequency of the square wave applied thereto, timing means connected to the line voltage connected for powering the lamp and to said converter means for producing a gate signal to said gate semiconductor, a high frequency voltage to said receiving means at a predetermined lowest frequency producing a full dim brightness response, a high frequency voltage to said receiving means at a predetermined highest frequency producing a full bright brightness response, and a high frequency therebetween producing a brightness response therebetween.

17. A gate-controlling circuit in accordance with claim 16, wherein said receiving means is connected to the line voltage, the line voltage having superimposed thereon the high frequency voltage, said receiving means including filtering means for separating the high frequency voltage from the line voltage and lower frequency voltages at frequencies below the lowest high frequency voltage.

18. A gate-controlling circuit in accordance with claim 17, wherein said filtering means includes a plurality of high pass filters for greatly attenuating frequencies below 20 KHz.

19. A gate-controlling circuit in accordance with claim 16, wherein said receiving means includes high gain amplifier and limiting means for producing a predetermined constant-amplitude, square-wave voltage at the same frequency as that applied thereto.

20. A gate-controlling circuit in accordance with claim 19, wherein said high gain amplifier and limiting means include a plurality of CMOS amplifier stages.

21. A gate-controlling circuit in accordance with claim 16, wherein said frequency-to-voltage converter means includes a voltage doubler.

22. A gate-controlling circuit in accordance with claim 16, wherein said frequency-to-voltage converter means includes a frequency discriminator having a capacitor and a diode gate, a voltage at a frequency below said lowest frequency not establishing sufficient voltage on said capacitor to cause conduction of said diode gate for modifying the gate signal from said timing means to said gated semiconductor.

23. A gate-controlling circuit in accordance with claim 22, and including discharge means connected to said capacitor for discharging said capacitor prior to the period of each one-half cycle of line voltage.

24. A gate-controlling circuit in accordance with claim 16, wherein said frequency-to-voltage converter means includes an RC time constant network having a frequency discriminator for frequencies above said highest frequency, a frequency at said highest frequency effectively producing a square wave that builds to a predetermined voltage level during the period of one-half cycle of line voltage indicative of said full bright response.

25. A gate-controlling circuit in accordance with claim 24, and including discharge means connected to a capacitor portion of said RC time constant network for discharging said capacitor prior to the period of each one-half cycle of line voltage.

26. A gate-controlling circuit in accordance with claim 25, wherein said discharge means includes a diode connected to said capacitor and the output of said timing means.

27. A gate-controlling circuit in accordance with claim 16, wherein said timing means includes means for producing uniform square-wave pulses at a time within the half cycles of the line voltage determined by the frequency of the applied high frequency voltage, the predetermined highest frequency producing said pulses shortly following the beginning of the half cycles and the predetermined lowest frequency producing said pulses shortly before the ending of the half cycles.

28. A gate-controlling circuit in accordance with claim 24, wherein said timing means includes a first timer activated by the anticipated zero-crossing of the line voltage to produce a positive-going square-wave edge to a first voltage level, the voltage from said converter means producing a negative-going square-wave edge to a second voltage level, and a second timer connected to said first timer and to a constant level dc voltage for producing a uniform square-wave pulse starting at the occurrence of said negative-going square wave.

29. A gate-controlling circuit in accordance with claim 28, and including a differentiator connected to the output of said first timer and the input of said second timer for producing a spike pulse at the occurrence of said negative-going square-wave edge.

30. A gate-controlling circuit in accordance with claim 16, and including two series, oppositely connected Zener diodes for assuring that bypass gating of said semiconductor only occurs within a predetermined range of occurrence of line voltage.

* * * * *